US006145767A

United States Patent [19]

Hostettler

[11] Patent Number: 6,145,767

[45] Date of Patent: Nov. 14, 2000

[54] FEEDER MODULE FOR A ROLLER ROLL AND METHOD OF MILLING PRODUCTS USING A FEEDER MODULE IN A ROLLER MILL

[75] Inventor: Rene Hostettler, Sirnach, Switzerland

[73] Assignee: Bühler AG, Uzwil, Switzerland

[21] Appl. No.: 09/147,784

[22] PCT Filed: Sep. 24, 1997

[86] PCT No.: PCT/CH97/00362

§ 371 Date: Mar. 8, 1999

§ 102(e) Date: Mar. 8, 1999

[87] PCT Pub. No.: WO98/25702

PCT Pub. Date: Jun. 18, 1998

[30] Foreign Application Priority Data

Dec. 13, 1996 [DE] Germany ..... 196 51 836

[51] Int. Cl.[7] ..... B02C 4/28

[52] U.S. Cl. ..... 241/135; 241/143; 241/285.3

[58] Field of Search ..... 241/135, 143, 241/285.3

[56] References Cited

U.S. PATENT DOCUMENTS

| | | | |
|---|---|---|---|
| 4,938,425 | 7/1990 | Williams et al. | 241/285.3 |
| 5,498,207 | 3/1996 | Cappon et al. | 241/285.3 |
| 5,657,934 | 8/1997 | Pirrung et al. | 241/285.3 |

FOREIGN PATENT DOCUMENTS

| | | |
|---|---|---|
| 0038054 | 10/1981 | European Pat. Off. . |
| 0334919 | 9/1993 | European Pat. Off. . |
| 291517 | 12/1914 | Germany . |
| 821754 | 11/1951 | Germany . |
| 2011783 | 10/1970 | Germany . |
| 2403351 | 9/1974 | Germany . |
| 2462414 | 2/1977 | Germany . |
| 2730166 | 1/1978 | Germany . |
| 3404732 | 8/1984 | Germany . |
| 93/13857 | 7/1993 | WIPO . |

*Primary Examiner*—Mark Rosenbaum
*Attorney, Agent, or Firm*—Greenblum & Bernstein, P.L.C.

[57] ABSTRACT

Feeder module for use in a roller mill. The roller mill has a housing having an inlet adapted to receive a product to be milled and an outlet adapted to output the milled product. The roller mill further has at least one pair of milling rollers disposed in the housing between the inlet and the outlet, the rollers being adapted to mill the product. The feeder module has a frame and a distribution and feed device. The distribution and feed device is adapted to accommodate the product from the inlet, and is further adapted to distribute the product over the length of the milling rollers, and is still further adapted to feed the distributed product onto the milling roller. The feeder module is adapted to be pivoted in the housing between a working position and an open position, and when in the working position, the distribution and feed device is positioned between the inlet and the milling rollers, and when in the open position, access to at least the distribution and feed device is provided. Also provided is a method of milling products using a feeder module in a roller mill.

24 Claims, 3 Drawing Sheets

FEEDER MODULE FOR A ROLLER ROLL AND METHOD OF MILLING PRODUCTS USING A FEEDER MODULE IN A ROLLER MILL

BACKGROUND OF THE INVENTION

1. Field of the Invention

The invention relates to a feeder module for a roller mill and a method of milling products using a feeder module in a roller mill, and more particularly, relates to a roller mill for the production of cereal products and the like in cereal mills, fodder mills and other mill operations.

2. Discussion of Background Information

Roller mills for the production of milled products especially for milling of cereals are mostly equipped with feed rollers for the distribution as evenly as possible over the entire length of the milling rollers of the product to be ground or milled. EP-B-38054, for instance, describes a product feed control whereby the cereal reaches feed and loosening rollers from a feed room. This is followed by a dosing valve which in turn is connected with a signal sensor in the feed room to adjust a dosing gap by use of the dosing valve. The access to this feed device is provided by use of an inspection door and an inspection flap. In order to achieve accessibility for cleaning and maintenance purposes, various linings, etc., must be removed. Additional feed devices for instance described in DE-PS 2011783, DE-PS 240351, DE-A-2462414 or DE-A-3404732 do not go beyond this state-of-the-art.

SUMMARY OF THE INVENTION

The present invention provides a feeder module for use in a roller mill, and a method of milling products using a feeder module in a roller mill. The feeder module may be adapted for use in the production of milled cereal products.

The feeder module of the present invention includes roller mill having a housing having an inlet adapted to receive a product to be milled and an outlet adapted to output the milled product. The roller mill further has at least one pair of milling rollers disposed in the housing between the inlet and the outlet, the rollers being adapted to mill the product. The feeder module has a frame and a distribution and feed device. The distribution and feed device is adapted to accommodate the product from the inlet, and is further adapted to distribute the product over the length of the milling rollers, and is still further adapted to feed the distributed product onto the milling roller. The feeder module is adapted to be pivoted in the housing between a working position and an open position, and when in the working position, the distribution and feed device is positioned between the inlet and the milling rollers, and when in the open position, access to at least the distribution and feed device is provided.

According to a certain aspect of the invention, the frame may be generally pie segment-shaped. Also, the feeder module may be installed in and removed from the housing as a separate assembly.

The distribution and feed device may include a distribution roller and a feed roller adapted to distribute the product over the length of the milling rollers, and further adapted to transport the distributed product to the milling rollers.

According to another aspect of the invention, a dosing facility adapted for the controlled feeding of the product to the milling rollers may be provided. Also, the dosing facility may include a dosing valve.

Additionally, the frame may be adapted to pivot about a fulcrum in the housing. Also, the distribution and feed device may be engaged and disengaged either manually or by a motor.

The method of milling products using a feeder module in a roller mill, includes receiving the product from the inlet, distributing, by the distribution and feed device, the product over the length of the milling rollers, feeding, by distribution and feed device, the distributed product onto the milling roller, and pivoting the feeder module in the housing between the working position and the open position.

The method may also include installing and removing the feeder module from the housing as a separate assembly. The method may further include dosing the product to the milling rollers, and may optionally be performed by a dosing valve.

Furthermore, the method may further comprise engaging and disengaging the distribution and feed device manually and/or by a motor.

Also, the pivoting of the feeder module may be performed by pivoting the frame about a fulcrum.

The invention further develops the feeder device of a typical roller mill, for instance according to DE-C-2730166 or EP-B-334919, so that a significant improvement of the sanitation and accessibility is achieved with simple and operationally safe construction. This task is solved by the present invention. The feeder device according to the invention is constructed as a feeder module with the entire assembly being arranged to permit pivot action. In doing so, the feed and the distribution rollers are accommodated in a generally pie segment-shaped frame with a dosing valve and guide panels. The frame is arranged to pivot around an upper fulcrum.

In addition, the invention permits additional advantageous embodiments. It is also possible to arrange the remaining front covers or panels to pivot laterally or upward at the same time (refer WO 93/13857). Dosing and guide panels for the goods to be milled can also be provided with a vibrating dosing facility in which case especially a conventional dosing valve is replaced.

In addition, a generally customary milling gap aspiration is designed according to DE-A-2403351 so that dragged air can be stopped above the milling rollers.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by which of non-limiting examples of certain embodiments of the present invention, in which like numerals represent like elements throughout the several view of the drawings, and wherein.

DETAILED DESCRIPTION OF THE PRESENT INVENTION

Figure 1:
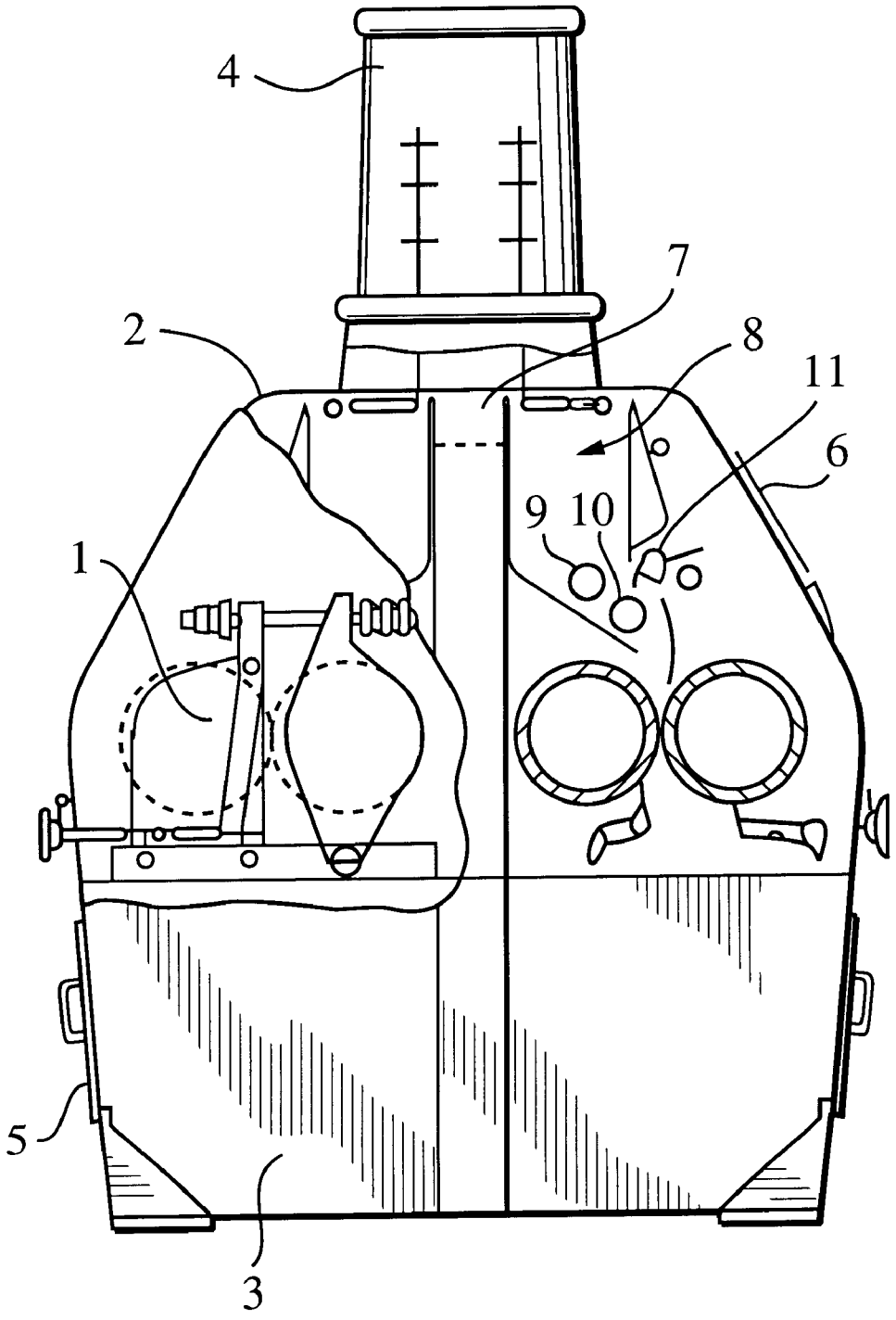
FIG. 1: Shows a schematic representation of a four-high roller mill having a feeder module according to the invention.
Figure 2:
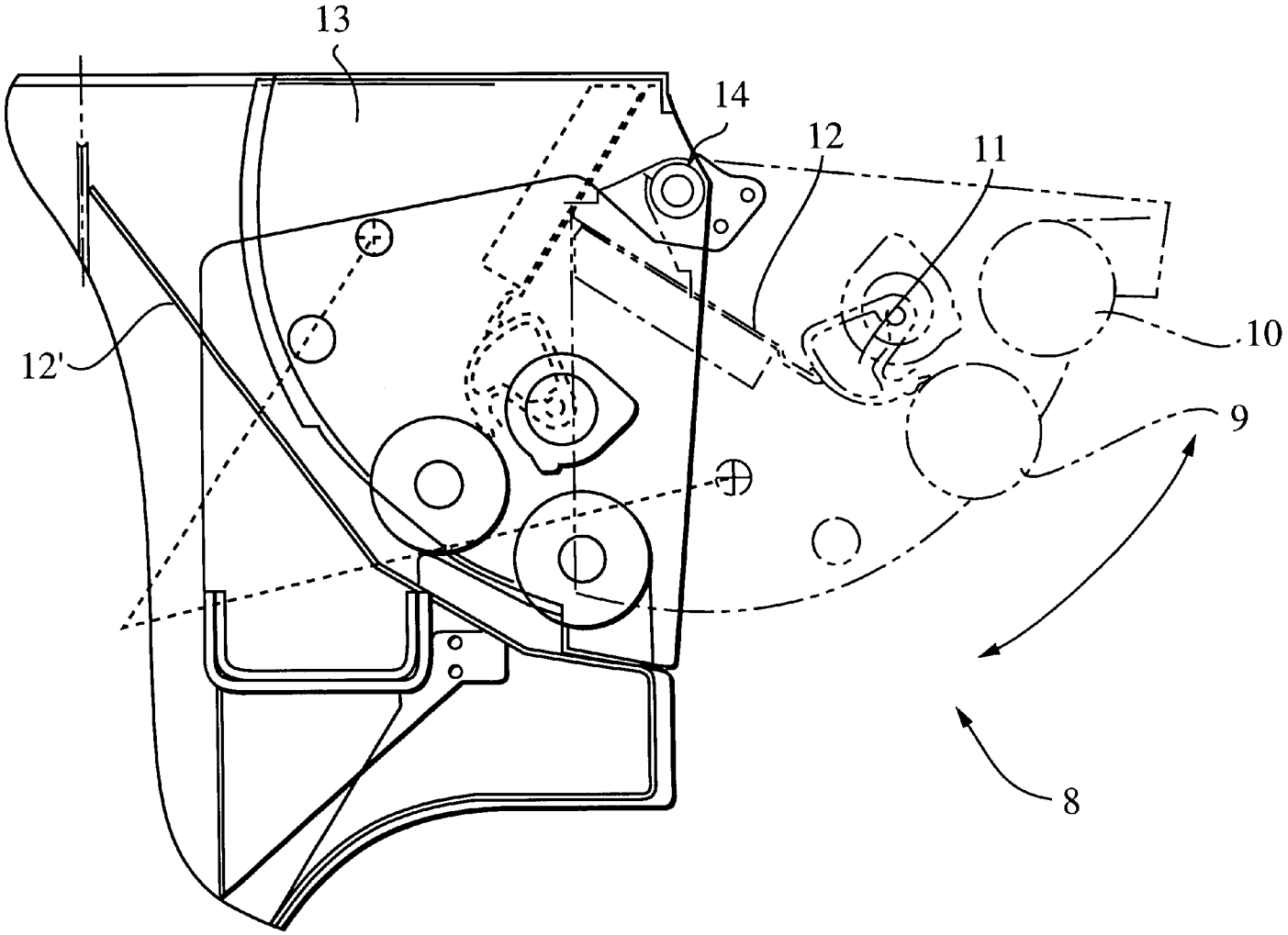
FIG. 2: Shows the feeder module in a working position and pivoted out according to the invention.
Figure 3:
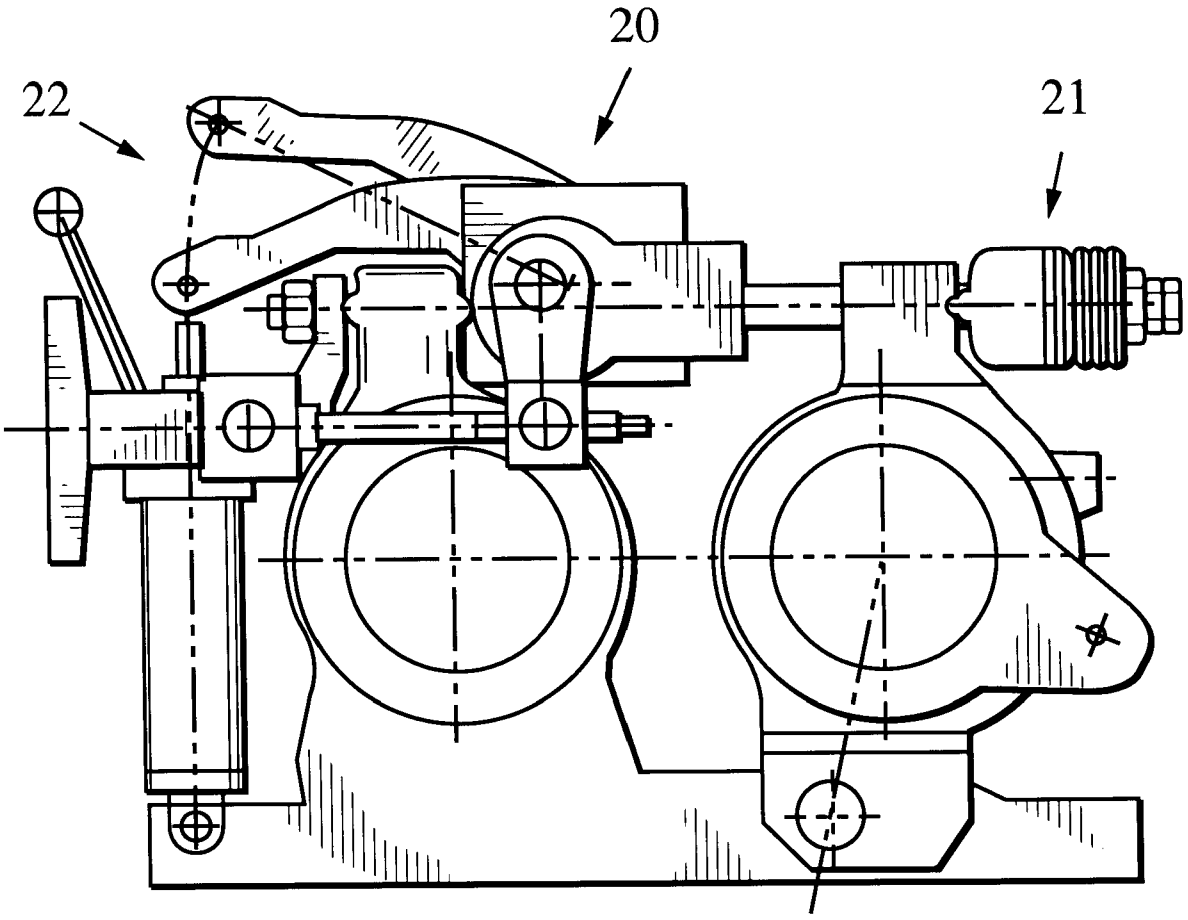
FIG. 3: Shows a roller assembly (roller pair).

Referring to the drawings wherein like numerals represent like elements, FIGS. 1–3 show a roller mill having a feeder module according to the invention. The milling roller mill has two pairs of rollers 1 arranged next to one another or even two pairs of rollers 1 arranged in each halve of the roller mill (directly) above one another includes a frame 3 on which the roller pairs 1 are supported in a known way (refer DE-C-2730166 etc.). The roller mill is further provided with a support structure 7 attached to the frame 3 or is part of this frame 3. The frame 3 and the support structure 7 mainly form the housing of the roller mill and this design is typically surrounded by panelling 2. A product feed channel 4 is arranged to end in the center of the roller mill.

Inspection doors 5, 6 and one feeder device each are provided on both roller mill halves. The panelling 2 and the entire product feed (4, 8) are supported by the support structure 7. The feeder device 8 includes mainly a distribution roller 9 and a feed roller 10 as well as a dosing valve 11 (as dosing device) and guide panels 12 for the milled product wherein these elements are mounted and guided in a generally pie segment-shaped frame 13. The frame 13 is able to pivot around a fulcrum 14. The distribution roller 9 and the feed roller 10 are operated by an overdrive and/or direct drive (not shown). The dosing valve 11 is driven in a known way (electro-) pneumatically (not shown). The pivotability of the frame 13 makes it possible to also provide an open position for inspection and the like, in addition to the working position of the feed device 8.

If the product to be milled/ground is fed into the product feed channel 4, a sensor (not shown) recognizes the arriving product to be ground and engages the rollers of the roller pairs 1. The milling gap is adjusted in a known way, such as manually or automatically. If a product is being milled for the first time, the inspection door 5 may be opened and product samples drawn at several places over the length of the roller. Accordingly, readjustments at necessary time intervals may be conducted.

The basic construction of the roller mill according to the invention and its operation can be seen according to DE-C-2730166 and also EP-B-334919 (constructed as a conventional four-high or eight-high roller mill).

A further version of the feeder module not explicitly represented incorporates the omission of a conventional dosing valve 11. This is conventional dosing valve 11 may be replaced by a vibrating dosing element which is preferably constructed as a single axis and is designed in form of a panel and/or a Piezo foil.

It is advantageous, in addition to the above-described feeder module, to construct each roller pair in the form of a roller assembly which is known from DE-C-2730166 while in its further development by means of a double eccentric cam 20 overload protection 21 and clamping eccentric cam 22 are combined. The space requirement can thus be reduced.

What is claimed is:

1. A roller mill comprising:

a housing comprising:

an inlet adapted to receive a product to be milled; and an outlet adapted to output the milled product;

at least one pair of milling rollers disposed in said housing between said inlet and said outlet, said rollers adapted to mill the product;

a feeder module comprising:

a) a frame; and b) a distribution and feed device comprising a distribution roller and a feeding roller, said distribution and feed device adapted to accommodate the product from said inlet, and further adapted to distribute the product over the length of said milling rollers, and still further adapted to feed the distributed product onto said milling rollers; and wherein said feeder module is adapted to be pivoted in said housing about an axis extending parallel to a longitudinal axis of said milling rollers, between a working position and an open position, wherein when in the working position, said distribution and feed device is positioned between said inlet and said milling rollers, and when in the open position, access to at least the distribution and feed device is provided.

2. The roller mill according to claim 1, wherein said frame is generally pie segment-shaped.

3. The roller mill according to claim 1, wherein said feeder module is adapted to be installed in and removed from said housing as a separate assembly.

4. The roller mill according to claim 1, wherein said distribution and feed device comprises:

a distribution roller; and a feed roller adapted to distribute the product over the length of said milling rollers, and further adapted to transport the distributed product to said milling rollers.

5. The roller mill according to claim 1, wherein said feeder module further comprises a dosing facility adapted for the controlled feeding of the product to said milling rollers.

6. The roller mill according to claim 5, said dosing facility comprising a dosing valve.

7. The roller mill according to claim 1, wherein said frame is adapted to pivot about a fulcrum provided in said housing.

8. The roller mill according to claim 1, said distribution and feed device being adapted to be engaged and disengaged by at least one of manually or by motor.

9. A feeder module for a roller mill, the roller mill having a housing, an inlet adapted to receive a product to be milled, and a pair of milling rollers disposed within the housing, the feeder module comprising:

a distribution roller;

a feed roller;

a dosing device; and a frame that houses said distribution roller, said feed roller and said dosing device, said frame being adapted to pivot about a fulcrum extending in a direction parallel to a longitudinal axis of said distribution roller; and wherein said distribution roller, said feed roller and said dosing device have a length so as to correspond to a length of the inlet.

10. A feeder module for use in a roller mill, the roller mill having a housing, the housing having an inlet adapted to receive a product to be milled and an outlet adapted to output the milled product, the roller mill further having at least one pair of milling rollers disposed in the housing between the inlet and the outlet, the rollers being adapted to mill the product, the feeder module comprising:

a frame; and a distribution and feed device adapted to accommodate the product from the inlet, and further adapted to distribute the product over the length of the milling rollers, and still further adapted to feed the distributed product onto said milling rollers; and wherein said feeder module is adapted to be pivoted about an axis extending parallel to a longitudinal axis of said milling rollers in the housing between a working position and an open position, wherein when in the working position, said distribution and feed device is positioned between the inlet and the milling rollers, and when in the open position, access to at least the distribution and feed device is provided.

11. The feeder module according to claim 10, wherein said frame is generally pie segment-shaped.

12. The feeder module according to claim 10, wherein the feeder module is adapted to be installed in and removed from the housing as a separate assembly.

13. The feeder module according to claim 10, wherein said distribution and feed device comprises:

a distribution roller; and a feed roller adapted to distribute the product over the length of the milling rollers, and further adapted to transport the distributed product to the milling rollers.

14. The feeder module according to claim 10, further comprising a dosing facility adapted for the controlled feeding of the cereal product to the milling rollers.

15. The feeder module according to claim 14, said dosing facility comprising a dosing valve.

16. The feeder module according to claim 10, wherein said frame is adapted to pivot about a fulcrum in the housing.

17. The feeder module according to claim 10, said distribution and feed device being adapted to be engaged and disengaged by at least one of manually or by motor.

18. The feeder module according to claim 10, wherein the feeder module is adapted for use in the production of milled cereal products.

19. A method of milling products using a feeder module in a roller mill, the roller mill having a housing, the housing having an inlet adapted to receive a product to be milled and an outlet adapted to output the milled product, the roller mill further having at least one pair of milling rollers disposed in the housing between the inlet and the outlet, the rollers being adapted to mill the product, the feeder module having a frame and a distribution and feed device, the method comprising:

receiving the product from the inlet;

distributing, by the distribution and feed device, the product over the length of the milling rollers;

feeding, by the distribution and feed device, the distributed product onto the milling rollers;

milling, by the milling rollers, the distributed product; and pivoting the feeder module in the housing about a fulcrum extending parallel to a longitudinal axis of the milling rollers between a working position and an open position, wherein when in the working position, the distribution and feed device is positioned between the inlet and the milling rollers, and when in the open position, access to at least the distribution and feed device is provided.

20. The method of milling products using a feeder module in a roller mill according to claim 19, further comprising installing and removing the feeder module from the housing as a separate assembly.

21. The method of milling products using a feeder module in a roller mill according to claim 19, further comprising dosing the product to the milling rollers.

22. The method of milling products using a feeder module in a roller mill according to claim 21, wherein said dosing is performed by a dosing valve.

23. The method of milling products using a feeder module in a roller mill according to claim 19, further comprising engaging and disengaging the distribution and feed device by at least one of manually or by motor.

24. The method of milling products using a feeder module in a roller mill according to claim 19, wherein said pivoting of the feeder module is performed by pivoting the frame about a fulcrum.

* * * * *